US012305893B1

(12) United States Patent
Alcantar et al.

(10) Patent No.: US 12,305,893 B1
(45) Date of Patent: May 20, 2025

(54) SYSTEMS AND PROCESSES FOR STIMULATING SUBTERRANEAN GEOLOGIC FORMATIONS

(71) Applicant: MAZAMA ENERGY, INC., Seattle, WA (US)

(72) Inventors: Jonathan Alcantar, Plano, TX (US); Gabrijel Grubac, Zrenjanin (RS); Abdel Wadood Mohamed El-Rabaa, Plano, TX (US)

(73) Assignee: MAZAMA ENERGY, INC., Seattle, WA (US)

( * ) Notice: Subject to any disclaimer, the term of this patent is extended or adjusted under 35 U.S.C. 154(b) by 0 days.

(21) Appl. No.: 18/802,048

(22) Filed: Aug. 13, 2024

Related U.S. Application Data

(60) Provisional application No. 63/662,142, filed on Jun. 20, 2024.

(51) Int. Cl.
*F24T 10/20* (2018.01)
*E21B 43/267* (2006.01)

(52) U.S. Cl.
CPC ..... *F24T 10/20* (2018.05); *E21B 43/267* (2013.01); *E21B 2200/20* (2020.05)

(58) Field of Classification Search
CPC ..... E21B 43/267; E21B 2200/20; F24T 10/20
See application file for complete search history.

(56) References Cited

U.S. PATENT DOCUMENTS

| | | | | |
|---|---|---|---|---|
| 2,970,645 | A * | 2/1961 | Glass | E21B 43/261 405/53 |
| 3,650,337 | A | 3/1972 | Andrews et al. | |
| 4,912,941 | A | 4/1990 | Buchi | |
| 4,974,675 | A | 12/1990 | Austin et al. | |
| 5,482,116 | A | 1/1996 | El-Rabaa et al. | |
| 6,347,675 | B1 | 2/2002 | Kolle | |
| 6,543,538 | B2 | 4/2003 | Tolman et al. | |
| 7,331,385 | B2 | 2/2008 | Symington et al. | |
| 7,490,657 | B2 | 2/2009 | Ueyama | |
| 7,631,691 | B2 | 12/2009 | Symington et al. | |
| 8,201,626 | B2 | 6/2012 | Balczewski | |
| 8,540,020 | B2 | 9/2013 | Stone et al. | |
| 8,863,839 | B2 | 10/2014 | Kaminsky et al. | |
| 9,074,794 | B2 | 7/2015 | Suryanarayana et al. | |
| 9,080,441 | B2 | 7/2015 | Meurer et al. | |
| 9,284,819 | B2 | 3/2016 | Tolman et al. | |
| 9,322,239 | B2 | 4/2016 | Boza et al. | |
| 9,328,600 | B2 | 5/2016 | Kaminsky et al. | |
| 9,541,309 | B2 | 1/2017 | Colwell | |

(Continued)

FOREIGN PATENT DOCUMENTS

| | | | |
|---|---|---|---|
| WO | WO2011005075 | A1 | 1/2011 |
| WO | WO2012173916 | A1 | 12/2012 |
| WO | WO2015066764 | A1 | 5/2015 |

OTHER PUBLICATIONS

U.S. Dept. of Energy, "*What is an Enhanced Geothermal System (EGS)?*", DOE/EE-0785, Sep. 2012.

(Continued)

*Primary Examiner* — Catherine Loikith

(74) *Attorney, Agent, or Firm* — Jeffrey L. Wendt; The Wendt Firm, P.C.

(57) ABSTRACT

Systems and processes for stimulating subterranean geologic formations to create an artificial stress barrier. Methods of modeling same.

26 Claims, 10 Drawing Sheets

(56) References Cited

U.S. PATENT DOCUMENTS

| | | | | |
|---|---|---|---|---|
| 9,703,904 | B2 | 7/2017 | Suryanarayana et al. | |
| 9,803,626 | B1 | 10/2017 | Eastman et al. | |
| 9,945,218 | B2 | 4/2018 | Tolman et al. | |
| 9,963,955 | B2 | 5/2018 | Tolman et al. | |
| 10,140,393 | B2 | 11/2018 | Hoda et al. | |
| 11,162,346 | B2 * | 11/2021 | Montalvo | E21B 43/25 |
| 11,634,986 | B2 | 4/2023 | Hu et al. | |
| 11,697,759 | B1 * | 7/2023 | Dusterhoft | C09K 8/72 166/280.2 |
| 2009/0126923 | A1 | 5/2009 | Montgomery | |
| 2010/0078169 | A1 | 4/2010 | Symington et al. | |
| 2010/0200237 | A1 | 8/2010 | Colgate et al. | |
| 2010/0282460 | A1 | 11/2010 | Stone et al. | |
| 2011/0067399 | A1 | 3/2011 | Rogers | |
| 2011/0146982 | A1 | 6/2011 | Kaminsky et al. | |
| 2012/0312545 | A1 | 12/2012 | Suryanarayana et al. | |
| 2013/0062055 | A1 | 3/2013 | Tolman et al. | |
| 2013/0068469 | A1 | 3/2013 | Lin et al. | |
| 2013/0112403 | A1 | 5/2013 | Meurer et al. | |
| 2013/0220604 | A1 | 8/2013 | El-Rabaa et al. | |
| 2013/0306315 | A1 | 11/2013 | Kaminsky et al. | |
| 2014/0190701 | A1 | 7/2014 | Humphreys | |
| 2015/0122453 | A1 | 5/2015 | Colwell | |
| 2015/0167441 | A1 | 6/2015 | Howell et al. | |
| 2015/0247372 | A1 | 9/2015 | Boza et al. | |
| 2015/0315890 | A1 | 11/2015 | Tolman et al. | |
| 2016/0168962 | A1 | 6/2016 | Tolman et al. | |
| 2023/0114197 | A1 | 4/2023 | Hughes | |

OTHER PUBLICATIONS

Muir, "*New Opportunities and Applications for Closed-Loop Geothermal Energy Systems*", Geothermal Rising Bulletin, Dec. 2020, vol. 49, No. 4.

Erkan, K. et al., "Understanding the Chena Hot Springs, Alaska", *Geothermics 37*(2008) 565-585.

Leuchenberg et al., "Development and Performance of Surface Equipment for High Temperature Underbalanced Drilling in Sour, Severely Under Pressured Formation", Mobil Oil (2004) pp. 1-10.

* cited by examiner

SYSTEMS AND PROCESSES FOR STIMULATING SUBTERRANEAN GEOLOGIC FORMATIONS

CROSS-REFERENCE TO RELATED APPLICATIONS

This application is entitled to and claims the benefit of earlier filed provisional application No. 63/662,142, filed Jun. 20, 2024, under 35 U.S.C. § 119 (e), which earlier filed provisional application is incorporated by reference herein in its entirety.

BACKGROUND INFORMATION

Technical Field

The present disclosure relates to systems and processes for stimulating subterranean geologic formations to create an artificial stress barrier, and more particularly to systems and processes for stimulating subterranean geologic formations to create an artificial stress barrier between injector and producer wells in enhanced geothermal systems.

Background Art

A naturally occurring geothermal system, known as a hydrothermal system, is defined by three key elements: heat, fluid, and permeability at depth. An Enhanced Geothermal System (EGS) is a man-made reservoir, created where there is hot rock but insufficient or little natural permeability or fluid saturation. In an EGS, fluid is injected into the subsurface under carefully controlled conditions, which cause pre-existing fractures to re-open, creating permeability. What is an Enhanced Geothermal System (EGS)? U. S. Dept. of Energy, DOE/EE-0785 Sep. 2012. A different approach, closed-loop geothermal systems (CLGS), overcomes permeability issues by circulating a working fluid through a sealed downhole heat exchanger to absorb and transport heat. CLGS is a versatile technology that can be implemented in a wide variety of different well pipe configurations using a choice of working fluids (such as water and sCO2) to optimize site specific costs and performance. Muir, New Opportunities and Applications for Closed-Loop Geothermal Energy Systems, Geothermal Rising Bulletin, December 2020, Vol. 49, No. 4.

Extraction of heat from Dry Hot Rock (DHR) presents several efficiency and power advantages over other EGS or CLGS approaches for geothermal energy recovery. To efficiently extract DHR heat, it is necessary to create a network of fractures to connect an injector well with one or more producer wells. However, in contrast with stimulation and extraction from hydrocarbon-bearing formations, stress barriers in geothermal reservoirs are not as prevalent in containing a fracture in terms of height during stimulation. In fact, fracture geometries grow in height more than compared to length. Moreover, dry hot rock formations are typically more homogenous than shales and stress barriers are weak. The geometry of a fracture produced by stimulation depends on the stress contrast between overburden (vertical stress, or Sv) and minimum horizontal stress (Shmin). During the propagation of the fracture, it will be easier to break through formations (overburden) than to create more length as energy is lost in at the tip of the fracture.

To address these problems, geothermal projects have started to use stimulation techniques that have shown successes in the O&G (oil and gas) industry to stimulate hydrocarbon-bearing formations, such as use of slickwater fracs, crosslinked fluids, limited entry, and completion designs using devices such as sleeves. These technologies have started to become prevalent in geothermal wells but do not address the height control of a fracture, which remains an unsolved problem. As may be seen, current practices may not be adequate for all circumstances, and do not address the noted problems with respect to extracting heat from DHR. There remains a need for more robust systems and processes for stimulating subterranean geologic formations, and in particular geothermal formations. The systems and processes of the present disclosure are directed to these needs.

SUMMARY

In accordance with the present disclosure, systems and processes are described which reduce or overcome many of the faults of previously known systems and processes. The systems and processes of the present disclosure create an artificial stress barrier prior to the main stimulation to provide the fracture propagation to be contained in the target interval. This method can be applied in vertical, deviated and horizontal wells, regardless of temperature of the formation and regardless of the completion of the well.

A first aspect of the disclosure are systems for stimulating subterranean geologic formations (in certain embodiments for stimulating subterranean geologic formations between injector and producer fractures in DHR wells) to create an artificial stress barrier comprising (or consisting essentially of, or consisting of):

(a) an injector well extending from a surface to a subterranean geologic formation and configured to be perforated;

(b) a pump configured to stimulate the subterranean geologic formation by:

(i) forming an artificial stress barrier at a first position in the subterranean geologic formation by pumping one or more first fluids at a first rate R1 into the subterranean geologic formation from the injector well to create a stimulation block at the first position, the first position in the subterranean geologic formation spaced apart from a second position in the subterranean geologic formation;

(ii) pumping one or more second fluids at a second rate R2 at the second position in the subterranean geologic formation from the injector well, R2 being suitable for a main stimulation of a fracture and/or natural non-fractured rock extending from the injector well to or near a producer well, where R2>R1, and wherein the one or more first and second fluids may be the same or different; and (c) a sub-system configured to measure blocking effect in subterranean geologic formation after formation of the artificial stress barrier by the stimulation block.

A second aspect of the disclosure are processes for stimulating subterranean geologic formations (in certain embodiments for stimulating subterranean geologic formation between injector and producer fractures in DHR wells) to create an artificial stress barrier comprising (or consisting essentially of, or consisting of):

(a) providing an injector well extending from a surface to a subterranean geologic formation;

(b) perforating the injector well at a first position;

(c) pumping one or more first fluids at a first rate R1 into the subterranean geologic formation at the first position forming an artificial stress barrier at the first position to create a stimulation block at the first position;

(d) perforating the injector well at a second position in the subterranean geologic formation, the second position in the subterranean geologic formation spaced apart from and below the first position;

(e) pumping the one or more second fluids at a second rate R2 into the subterranean geologic formation at the second position, R2 being suitable for a normal stimulation of a fracture extending from the injector well to or near a producer well, where R2>R1, and wherein the one or more first and second fluids may be the same or different.

In embodiments where the subject formation has been stimulated previously, it possible to performed StimBlock™ as follows:

(a) pumping one or more first fluids at a first rate R1 into the subterranean geologic formation at the first location (location of previous main stimulation) forming an artificial stress barrier at the first location to create a stimulation block at the first location;

(b) perforating the injector well and formation at a perforation location above or below the first (previous) stimulation location; and (c) pumping the one or more first fluids at a second rate R2 into the subterranean geologic formation at the perforation location above or below the first (previous) main stimulation location, thereby performing a second main stimulation.

Certain system and process embodiments may comprise wherein the subterranean geologic formation is a subterranean geothermal formation, and the injector well and producer well are in dry hot rock (DHR). In certain systems and processes of the present disclosure the injector well may be cemented. In yet other systems and processes the injector well may be uncemented.

Certain system and process embodiments may comprise wherein the production well is selected from an open hole, a well comprising a cemented or an uncemented liner, and a well selectively segmented by ECP and sliding sleeves or pre-perforated liner.

Certain system and process embodiments may comprise wherein the injector well is a vertical or deviated well and R1 is a rate and volume capable of introducing a net pressure increase in the subterranean geologic formation.

Certain system and process embodiments may comprise wherein the injector well is a vertical well and R1 is a high rate and volume capable of tensile fracturing the subterranean geologic formation by generating a downhole pressure that produces a stress on the subterranean geologic formation exceeding Shmin.

Certain system and process embodiments may comprise wherein the injector well is a vertical well and R1 is a pulsating mode (for example, but not limited to, sinusoidal) to cause fatigue to any existing natural fractures ("references") intersecting the tensile fracture, or to natural non-fractured rock, the pulsing mode having a pulse amplitude below Shmin with frequency determined by rock fabric of the subterranean geologic formation and bottom hole static temperature ("BHST").

Certain system and process embodiments may comprise wherein the injector well is a deviated well and R1 is a long injection period as a hydroshearing stage creating a stress/pressure less than Shmin, the pump capable of pumping a volume based on an estimated total porosity of natural fractures encountered in the subterranean geologic formation estimated from a borehole logging tool or from geologic settings of the subterranean geologic formation.

Certain system and process embodiments may comprise wherein the injector well is a horizontal well at the second position and the first position is shallower than the second position, and R1 is a rate and volume capable of limiting the effects of intersecting natural fractures creating complex fracture geometries selected from a small tensile fracture and a hydroshearing fracture to create the artificial stress barrier.

Certain system and process embodiments may comprise wherein the pump comprises one or more surface pumps. Yet other systems may comprise one or more surface pumps for a first injection path, and one or more other surface pumps for a second injection path, especially in embodiments where dual injection paths (inner conduit and annulus) are used.

Certain system and process embodiments may comprise wherein the one or more fluids is selected from water, brine, viscosified fluids, energizing fluids, and polymer based fluids.

Certain system and process embodiments may comprise wherein the injector well is configured to utilize single-path injection through either an inner conduit or through the annulus between the inner conduit and casing, wherein the inner conduit is selected from in place tubing, drill pipe, and coiled tubing.

Certain system and process embodiments may comprise wherein the injector well is configured to utilize dual injection paths comprising a first injection path through an inner conduit and a second injection path through an annulus between the inner conduit and casing, and wherein the pump comprises a first pump for the first injection path and a second pump for the second injection path. In these embodiments the one or more fluids may comprise a first fluid pumped by the first pump through the first injection path, and a second fluid pumped by the second pump through the second injection path, wherein the first and second fluids may be the same or different in one or more physical and/or chemical properties. Dual injection allows for a stimulated depth above the intended main stimulation depth to be stimulated first. In certain embodiments where the main stimulation treatment uses dual injection, there is no need for isolation of the well above the main stimulation.

Certain system and process embodiments may comprise wherein the one or more fluids comprises a first fluid configured to be pumped by the first pump through the first injection path, and a second fluid configured to be pumped by the second pump through the second injection path, wherein the first and second fluids are different in one or more physical and/or chemical properties.

Certain system and process embodiments may comprise wherein the one or more fluids comprises a propping agent such as sand, bauxite, petroleum coke, and the like.

Certain system and process embodiments may comprise measuring blocking effect in subterranean geologic formation after formation of the artificial stress barrier by the stimulation block, for example, but not limited to measuring improvement in injectivity index (Q/DP), where Q is volume flow rate and DP is pressure drop, and/or measuring pressure decline as compared by calculation of geothermal formation transmissivity (Kh/u) improvement of "references", where "Kh" is horizontal conductivity and "μ" is downhole fluid viscosity In certain embodiments the systems and processes of the present disclosure may comprise one or more components selected from the group consisting of one or more pressure control devices, (also referred to as chokes), one or more flow measurement devices, one or more accessory equipment, and combinations thereof. In certain embodiments the one or more accessory equipment may be selected from the group consisting of one or more connectors, one or more isolation valves, and one or more pressure relief valves. In certain embodiments the one or more components may comprise one or more redundant components in the system. Certain system embodiments may comprise one or more quick connect/quick disconnect connectors.

In certain embodiments a logic device may be provided to control all or portions of the systems and processes of the present disclosure, and the logic device may be configured to be operated and/or viewed from a Human/Machine Interface (HMI) wired or wirelessly connected to the logic device. Certain embodiments may include one or more audio and/or visual warning devices configured to receive communications from the logic device upon the occurrence of a pressure rise (or fall) in a sensed pressure above (or below) a set point pressure, or a change in concentration of one or more sensed concentrations or temperatures, or both, above one or more set points. The occurrence of a change in other measured parameters outside the intended ranges may also be alarmed in certain embodiments. Other measured parameters may include, but are not limited to, liquid or gas flow rate, and liquid density.

Certain system and process embodiments of this disclosure may operate in modes selected from the group consisting of automatic continuous mode, automatic periodic mode, and manual mode. In certain embodiments the one or more operational equipment may be selected from the group consisting of pneumatic, electric, fuel, hydraulic, and combinations thereof.

In certain embodiments, pressure (P), temperature (T), density, and/or mass flow may be sensed inside the injector and/or producer well tubing, the annulus, the subterranean geologic formation, or any combination of these. Mass flow sensors may be employed. All combinations of sensing T, P, density, and/or mass flow in the injector and/or producer tubing or inner pipe, in the annulus, and/or in the formation are disclosed herein and considered within the present disclosure.

As used herein "measurement sub-system" means a structure including a cabinet, frame, or other structural element supporting (and in some embodiments enclosing) connectivity and/or permeability measurement components and associated components, for example, but not limited to pressure control devices (backpressure valves), pressure relief devices (valves or explosion discs), pipes, conduits, vessels, towers, tanks, mass flow meters, temperature and pressure indicators, heat exchangers, pumps, compressors, and quick connect/quick disconnect (QC/QD) features for connecting and disconnecting choke umbilicals, kill umbilicals, and the like.

These and other features of the systems and processes of the present disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain producer wells may be devoid of casing; certain injector wells may be devoid of dual injection paths; certain systems may be devoid of more than one pump; certain fluids may be devoid of oils and/or other hydrocarbons, and/or devoid of carcinogenic compounds.

BRIEF DESCRIPTION OF THE DRAWINGS

The manner in which the objectives of this disclosure and other desirable characteristics can be obtained is explained in the following description and attached drawings in which.

Figure 1:
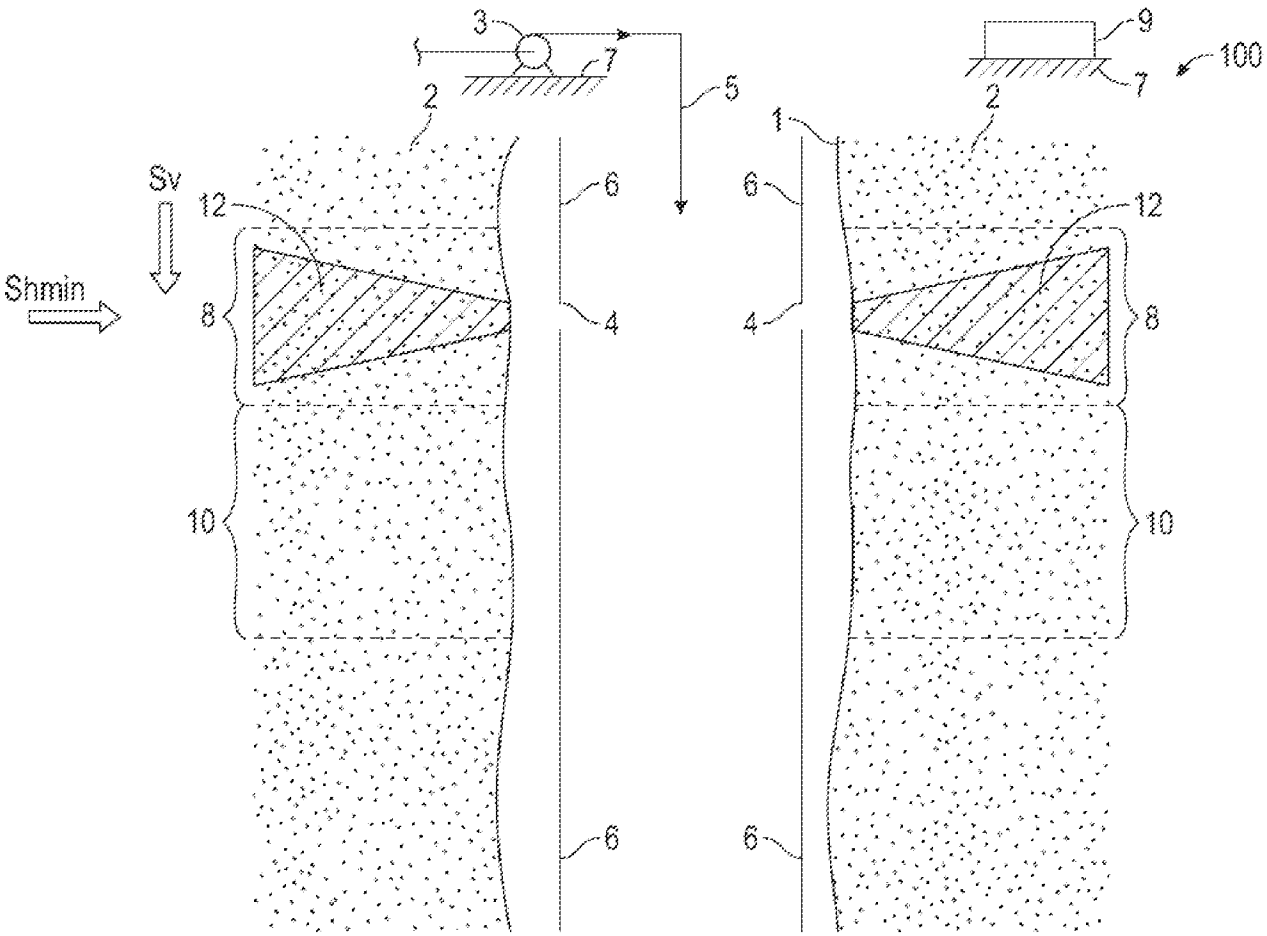
FIG. 1 is a schematic perspective illustration view of a subterranean geologic formation and a vertical injector well just after employing a first stimulation known under the trade designation StimBlock™ above a target zone.

It is to be noted, however, that the appended drawings are not to scale, and illustrate only typical system, process, and modeling method embodiments of the present disclosure. Therefore, the drawing figures are not to be considered limiting in scope, for the disclosure may admit to other equally effective embodiments. Identical reference numerals are used throughout the several views for like or similar elements.

DETAILED DESCRIPTION

In the following description, numerous details are set forth to provide an understanding of the disclosed systems, combinations, and processes. However, it will be understood by those skilled in the art that the systems and processes disclosed herein may be practiced without these details and that numerous variations or modifications from the described embodiments may be possible. All technical articles, published and non-published patent applications, standards, patents, statutes and regulations referenced herein are hereby explicitly incorporated herein by reference, irrespective of the page, paragraph, or section in which they are referenced. Where a range of values describes a parameter, all sub-ranges, point values and endpoints within that range or defining a range are explicitly disclosed herein. All percentages herein are by weight unless otherwise noted. In the event definitions of terms in the referenced patents and applications conflict with how those terms are defined in the present application, the definitions for those terms that are provided in the present application shall be deemed controlling. Where a range of values describes a parameter, all sub-ranges, point values and endpoints within that range are explicitly disclosed herein. This document follows the well-established principle that the words "a" and "an" mean "one or more" unless we evince a clear intent to limit "a" or "an" to "one." For example, when we state "a pump configured to produce an artificial stress barrier by", we mean that the specification supports a legal construction of "a pump" that encompasses structure distributed among multiple physical structures, and a legal construction of "a well" that encompasses structure distributed among multiple physical structures.

As mentioned herein, extraction of heat from Dry Hot Rock (DHR) presents several efficiency and power advantages over other EGS or CLGS approaches for geothermal energy recovery. To efficiently extract DHR heat, it is necessary to create a network of fractures to connect an injector well with one or more producer wells. However, in contrast with stimulation and extraction from hydrocarbon-bearing formations, stress barriers in geothermal reservoirs are not as prevalent in containing a fracture in terms of height during stimulation. In fact, fracture geometries grow in height more than compared to length. Moreover, dry hot rock formations are typically more homogenous than shales and stress barriers are weak. The geometry of a fracture produced by stimulation depends on the stress contrast between overburden (vertical stress, or "Sv") and minimum horizontal stress ("Shmin"). During the propagation of the fracture, it will be easier to break through formations (overburden) than to create more length as energy is lost in at the tip of the fracture.

To address these problems, geothermal projects have started to use stimulation techniques that have shown successes in the O&G (oil and gas) industry to stimulate hydrocarbon-bearing formations, such as use of slickwater fracs, crosslinked fluids, limited entry, and completion designs using devices such as sleeves. These technologies have started to become prevalent in geothermal wells but do not address the height control of a fracture, which remains an unsolved problem. As may be seen, current practices may not be adequate for all circumstances, and do not address the noted problems with respect to extracting heat from DHR. There remains a need for more robust systems and processes for stimulating subterranean geologic formations, and in particular geothermal formations. The systems and processes of the present disclosure are directed to these needs.

As described in more detail herein with reference to the various drawing figures, systems and processes of the present disclosure address problems identified by the inventors herein, namely the lack of adequate location control over fractures in subterranean geologic formations, in particular in geothermal formations. The inventors herein investigated and developed solutions to these problems.

Turning now to the drawing figures, FIG. 1 is a schematic illustration view of an injector well 1 extending from surface 7 to a subterranean geologic formation 2, illustrating the subterranean geologic formation 2 just after pumping a first stimulation fluid 12 known under the trade designation StimBlock™ employing a surface pump 3 and conduit 5 to a first stimulation zone 8, where first stimulation zone 8 is above a target stimulation zone 10. Embodiment 100 includes perforations 4 in casing 6 of injector well 1. The injector well 1 and a producer well (not illustrated) extend from the surface 7 into subterranean geologic formation 2. Existing natural fractures are not illustrated in FIG. 1 as they may not exist in all formations. Illustrated by arrows are the minimum horizontal stress ("Shmin") and vertical stress ("Sv") in formation 2. Embodiment 100 includes a sub-system 9 positioned at surface 7 configured to measure blocking effect in subterranean geologic formation 2 by first stimulation fluid 12 in first stimulation zone 8. In embodiment 100, sub-system 9 is configured to measure improvement in injectivity index (Q/DP); in other embodiments sub-system 9 may be configured to measure pressure decline by calculation of geothermal formation transmissivity (Kh/μ).

Figure 2:
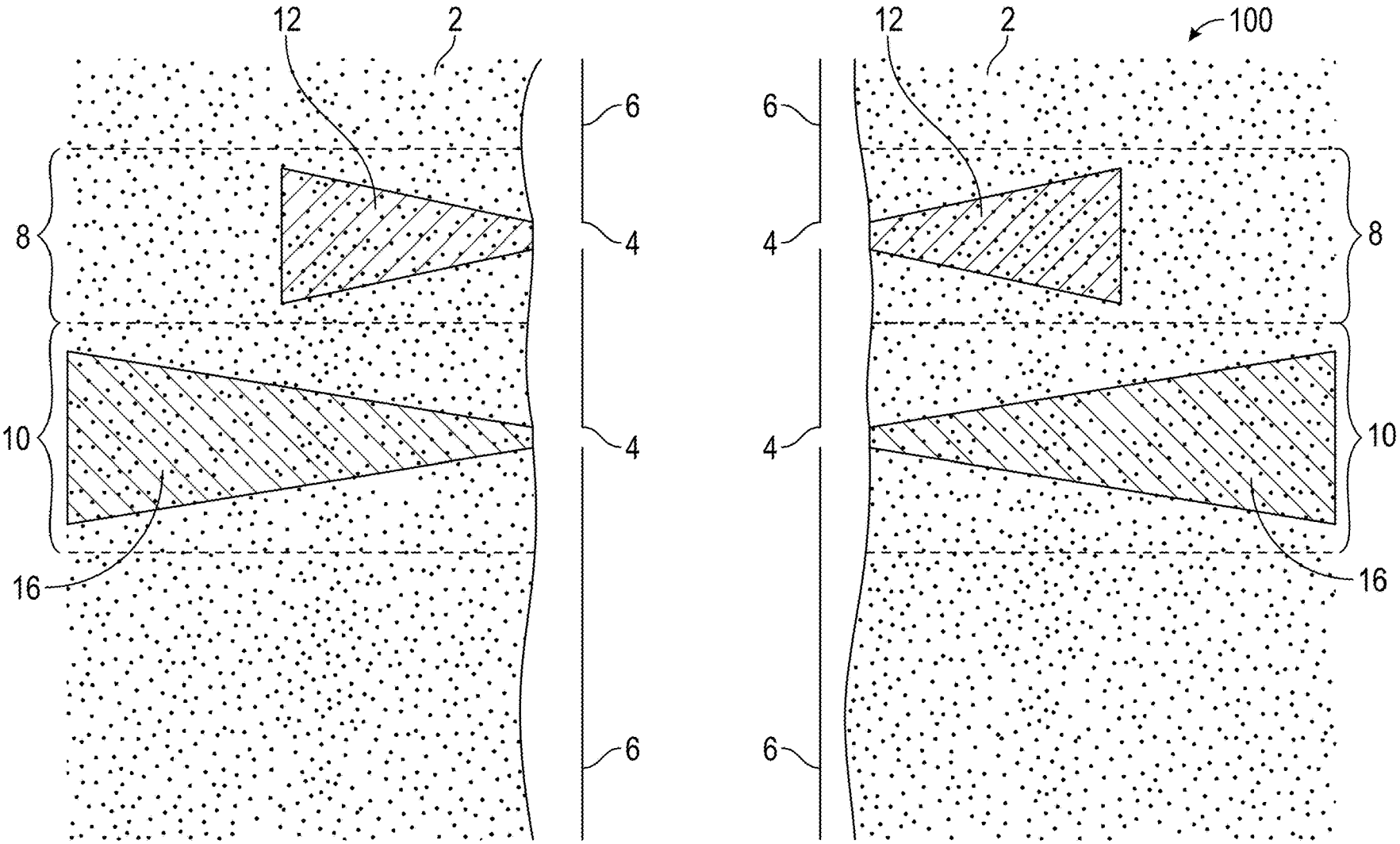
FIG. 2 is a schematic perspective illustration view of the subterranean geologic formation and injector well of FIG. 1 after a main stimulation treatment below the first stimulation known under the trade designation StimBlock™.

FIG. 2 is a schematic perspective illustration view of the subterranean geologic formation 2 and injector well 1 of FIG. 1 after injection of a main stimulation treatment fluid 16 in target stimulation zone 10 below first stimulation zone 8 where the first stimulation fluid 12 known under the trade designation StimBlock™ was previously injected. The height of main stimulation treatment fluid 16 in target stimulation zone 10 is restricted by the presence of the first stimulation fluid 12 in first stimulation zone 8.

Figure 3:
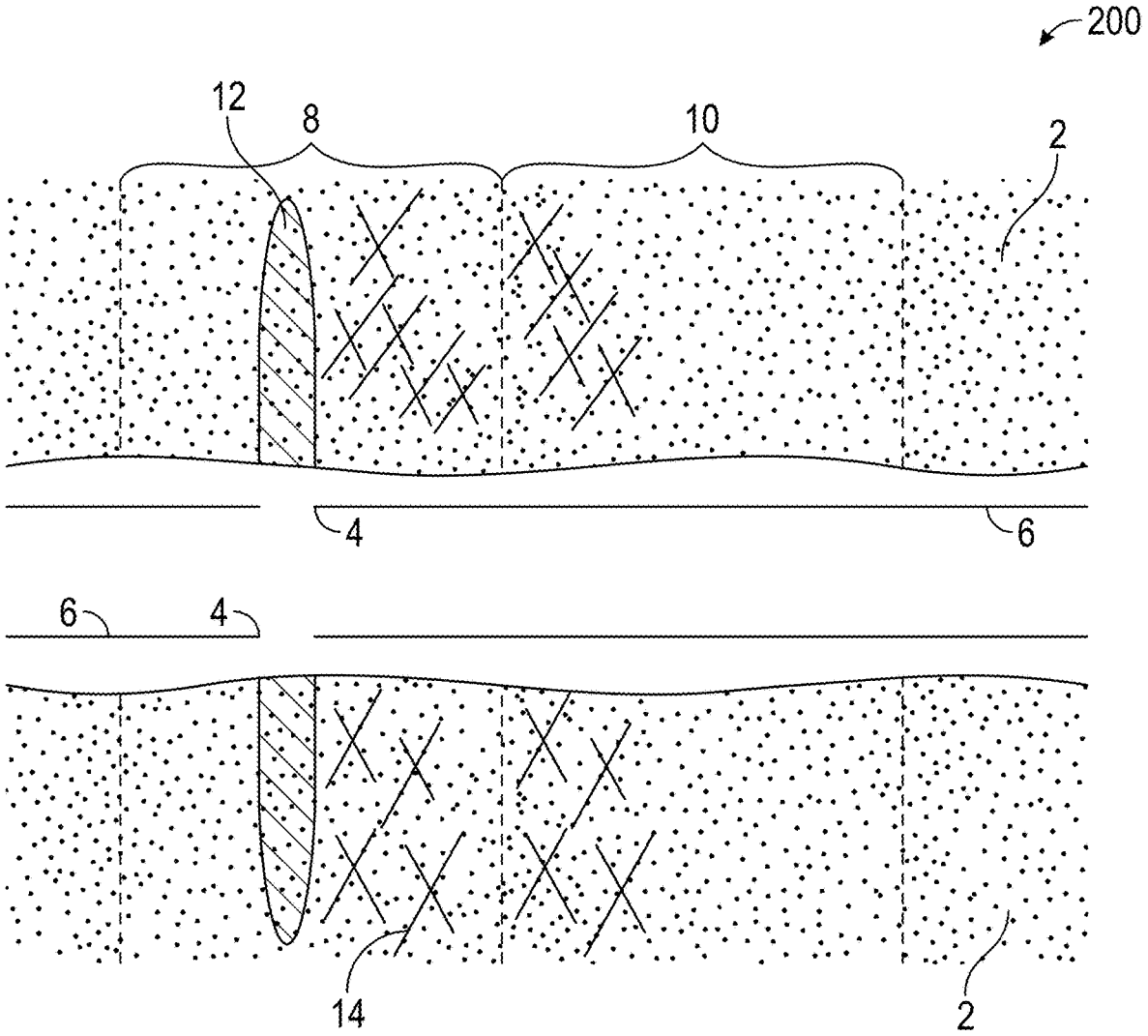
FIG. 3 is a schematic perspective illustration view of a subterranean geologic formation and a horizontal injector well just after employing a first stimulation known under the trade designation StimBlock™ next to a target zone.

FIG. 3 is a schematic perspective illustration view of another embodiment 200 of a subterranean geologic formation 2 and a horizontal injector well just after employing a first stimulation fluid 12 known under the trade designation StimBlock™ in a first stimulation zone 8 spaced apart from target stimulation zone 10. FIG. 3 illustrates natural fractures 14, sometimes referred to as "references", as various lines in formation 2.

Figure 4:
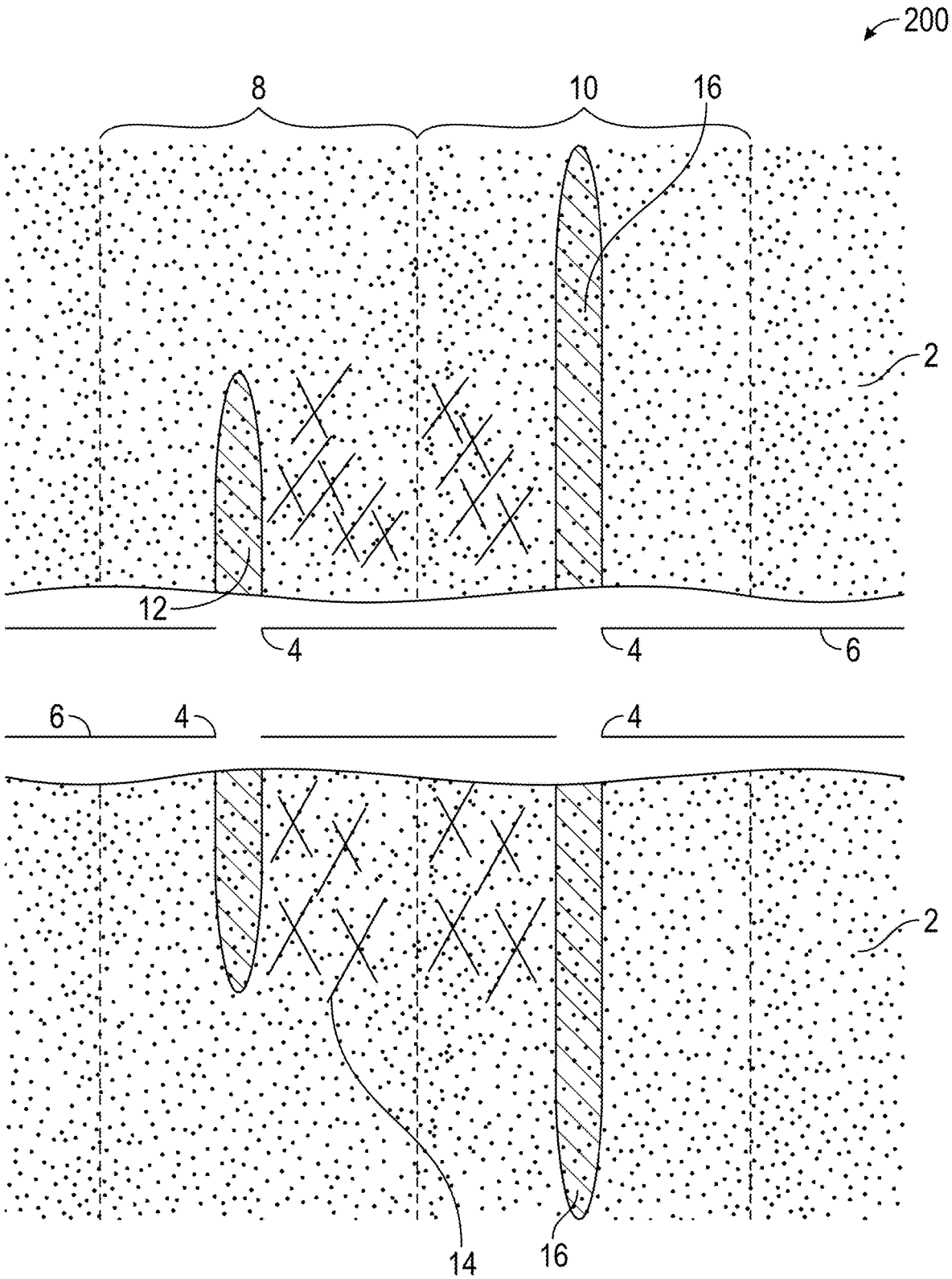
FIG. 4 is a schematic perspective illustration view of the subterranean geologic formation and injector well of FIG. 3 after a main stimulation treatment in a target zone next to the first stimulation known under the trade designation StimBlock™.

FIG. 4 is a schematic perspective illustration view of the subterranean geologic formation and injector well of FIG. 3 after injection of a main stimulation treatment fluid 16 in a target stimulation zone 10 after injection in first stimulation zone 8 of the first stimulation fluid 12 known under the trade designation StimBlock™. The spread of main stimulation treatment fluid 16 in target stimulation zone 10 is restricted by the presence of the first stimulation fluid 12 in first stimulation zone 8.

An injector well (vertical, deviated or horizontal) is drilled and fractured. Attempts can be made to assess fracture location and reach, using for example micro-seismic, fiber, and other techniques. A producer well is drilled towards the injector well's fracture network (vertical, deviated or horizontal). Injector well is stimulated, and connectivity is assessed utilizing diagnostics such as but not limited to micro-seismic, fiber, acoustic analysis, and the like. To effectively create a fracture network, the treatment known under the trade designation StimBlock™ (location and fluid) is used to limit the interaction between fractures in a vertical well. In a deviated well, the treatment known under the trade designation StimBlock™ is employed to limit the height using a shearing failure stimulation (hydroshearing) to limit growth of the fracture. In horizontal wells the treatment known under the trade designation StimBlock™ is used to limit the effects of intersecting natural fractures creating complex fracture geometries.

In essence, StimBlock™ is a stimulation technique to create an artificial stress barrier prior to main stimulation to control the height (or other location parameter) of the main stimulation. The process of creating an artificial stress barrier involves the creation of a relatively small stimulation treatment prior to the main treatment. The process details will depend on the type of completion a well is completed in. The treatment known under the trade designation StimBlock™ may be broken into two general types: 1) vertical/deviated wells; and 2) horizontal wells.

In vertical/deviated wells (in other words wells that begin at surface as vertical and then may or may not have one or more non-vertical sections) the process is to create a barrier above the intended stimulation zone by perforating the casing into the reservoir. Once this is done a small tensile fracture using one or more stimulation fluids produces a stress/pressure in the formation above Shmin (StimBlock™). The magnitude of stress/pressure and the fluid(s) used are based on modeling conducted to introduce a net pressure increase in the original reservoir section. Once this is completed, a second perforation in the casing will be made at a distance below the initial StimBlock™ treatment, where the main treatment will occur. Based on modeling the net pressure increase will create a stress barrier preventing the main stimulation treatment from growing in height.

In wells having a horizontal section, in certain embodiments the treatment known under the trade designation StimBlock™ will be performed at a shallower depth than the intended main stimulation. In this case the treatment known under the trade designation StimBlock™ is intended to prevent the fracture from creating complex geometry and maintaining the properties of the main fracture. The treatment known under the trade designation StimBlock™ will be either be a small tensile fracture producing a stress/pressure in the formation above Shmin, or a hydroshearing fracture producing a stress/pressure in the formation below Shmin to create a stress barrier. After the treatment known under the trade designation StimBlock™ the main stimulation treatment will follow. The treatment known under the trade designation StimBlock™ will aid in the length creation of the main stimulation geometry. Attempts can be made to assess fracture location and reach, using micro-seismic, fiber, and other techniques.

A pump is not illustrated in the various figures but would be on the surface. High pressure, high rate fracturing pumps are well-known and available from various commercial suppliers, including SLB, Halliburton, Baker Hughes, and others.

The stimulation fluids may further include propping agents, such as natural sands, bauxite particles, petroleum coke particles, and the like, which tend to maintain fractures open. A combination of fluids may be employed, and a single-path or dual-path injection strategy may be used, such as one pump creating a first flow of a first fluid in the tubing of an injector well and/or a producer well, and a second pump creating a second flow of a second fluid in the annulus of an injector well and/or a producer well. One or more producer wells extend from the surface to the subterranean geologic formation, wherein the producer well can be an open hole, or comprises a cemented or uncemented liner, or selectively segmented by ECP and sliding sleeves or pre-perforated liner. "ECP" refers to "embedded cylinder pipe", which is a type of concrete pressure pipe where a welded steel cylinder is embedded within a concrete core, then wrapped with high-tensile steel wire and coated with cement mortar.

If hydroshearing is employed, the volume for this stage will be based on the estimated total porosity of the natural fracture and/or natural rock encountered in the geological formation estimated from BHTV or similar logging tool or from geologic settings of the geologic formation. The measure of the "blocking" effect of the treatment known under the trade designation StimBlock™ can be assessed using the injectivity index (Q/DP) or the analysis of pressure decline which the analysis developed in the unconventional reservoir stimulation method as compared by the calculation of the geological formation transmissivity (kh/u) improvement "references".

Certain embodiments may entail methods of creating a stress barrier in a subterranean geologic formation, compromising:

(a) providing a deviated or vertical well extending from a surface to a subterranean formation, wherein the well is to be stimulated prior to the main stimulation technique;
(b) cementing and perforating the well using external packers, wherein the perforating is performed using conventional perforating guns or hydro-jetting methods;
(c) stimulating the deviated or vertical well using either:
  (i) a tensile fracture at stress above Shmin with smaller volume compared to that of the main stimulation technique, or
  (ii) injecting one or more fluids at a pressure lower than Shmin;
(d) immediately following the completion of step (c), performing a main stimulation; and
(e) optionally repeating steps (b) and (c) for completion of the subterranean geologic formation, creating artificial stress barriers to prevent height growth of the fracture produced during the main stimulation.

Certain other embodiments may entail methods of creating a stress barrier in a subterranean geologic formation, compromising:

(a) providing a well having at least one horizontal section (a "horizontal well") extending from a surface to a subterranean formation, wherein the well is to be stimulated prior to the main stimulation technique;
(b) cementing, or perforating the well using external packers, wherein the perforating is performed using conventional perforating guns or hydro-jetting methods;
(c) stimulating the horizontal well using either:
  (i) a tensile fracture at stress above Shmin with smaller volume compared to that of the main stimulation technique, or
  (ii) injecting one or more fluids at a pressure lower than Shmin;
(d) immediately following the completion of step (c), performing a main stimulation; and
(e) optionally repeating steps (b) and (c) for completion of the subterranean geologic formation, creating artificial stress barriers to prevent the fracture created during the main stimulation from coalescing with more natural fractures or creating complex geometry in the main fracture in the aide of increased length.

Figure 5:
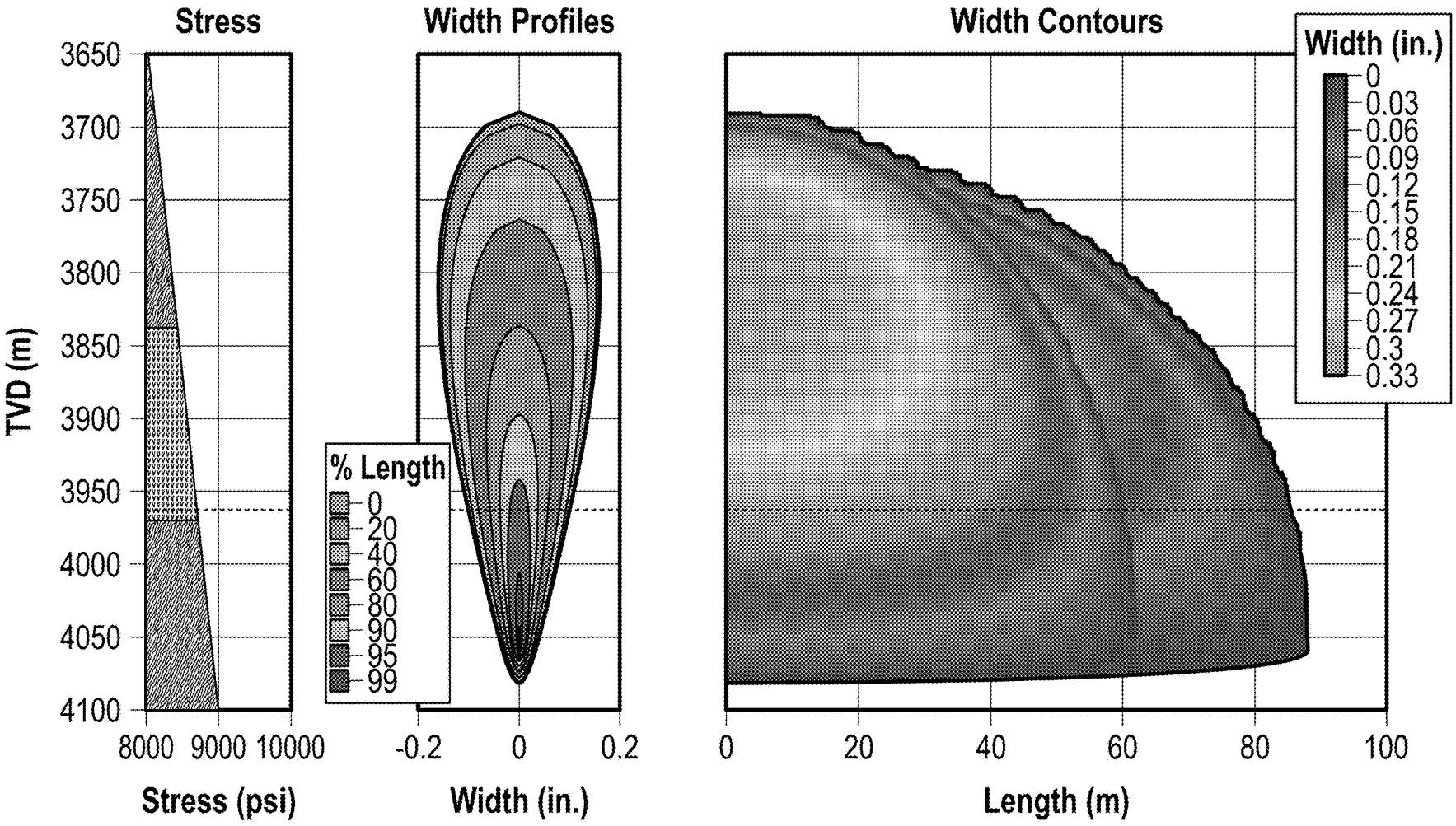
FIG. 5 is a graph schematically illustrating stress, width profile, and width contours produced by a main stimulation treatment of a subterranean geologic formation using a vertical injector well with no height containment by a previous stimulation known under the trade designation StimBlock™.

FIG. 5 is a graph schematically illustrating stress, width profile, and width contours produced by an actual main stimulation treatment of a known subterranean geologic formation using a vertical injector well with no height containment by a previous stimulation known under the trade designation StimBlock™. The main stimulation comprised stimulation treatment with 0.67 psi per foot, and no height containment. One can see from FIG. 5 the length of the treatment plume was about 90 m, and the height of the main stimulation treatment plume reached about 3800 m vertical depth.

Figure 6:
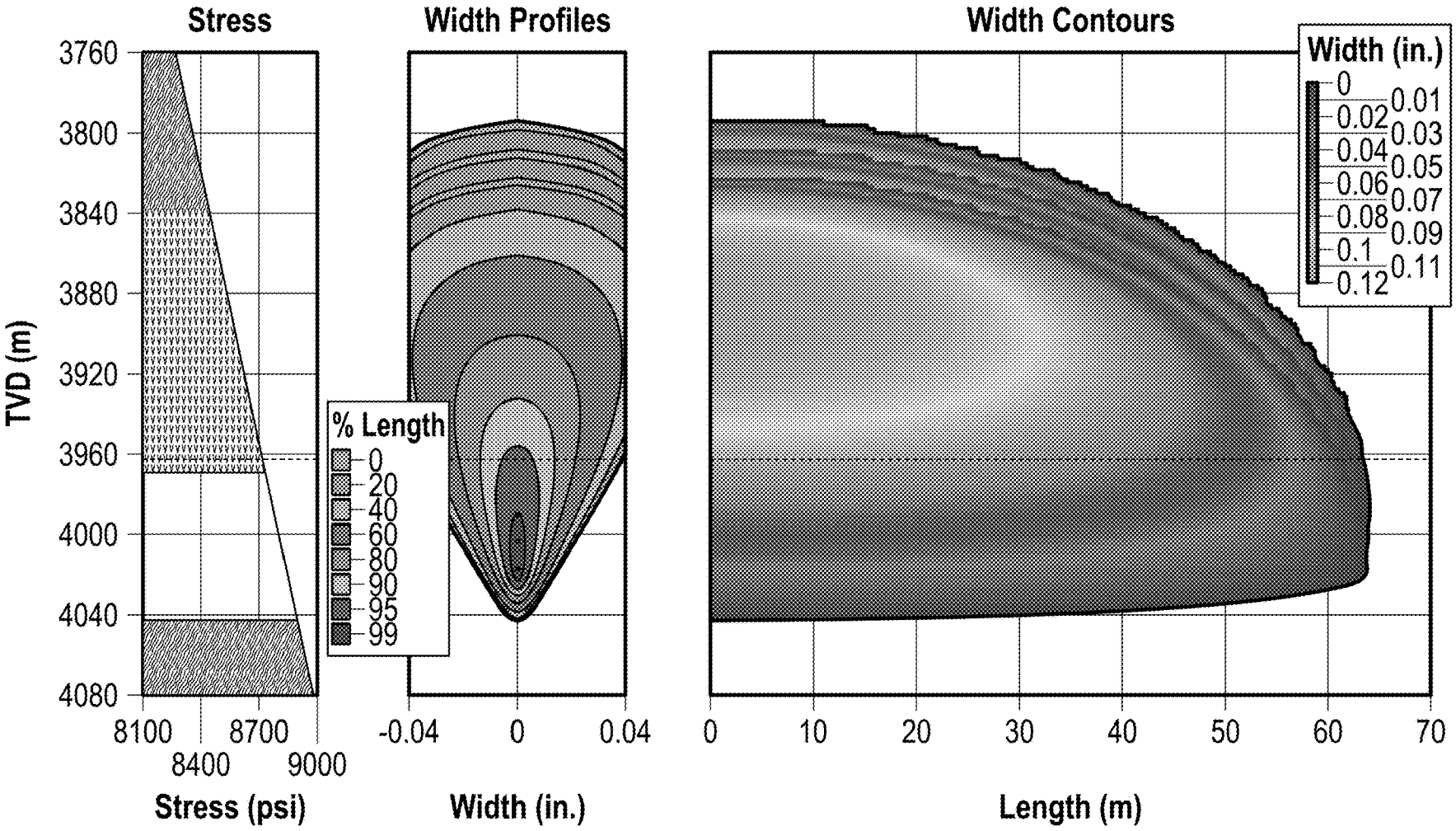
FIG. 6 is a graph schematically illustrating stress, width profile, and width contours produced by a simulated treatment of the same subterranean geologic formation of FIG. 5 using a vertical injector well with stimulation known under the trade designation StimBlock™.
Figure 7:
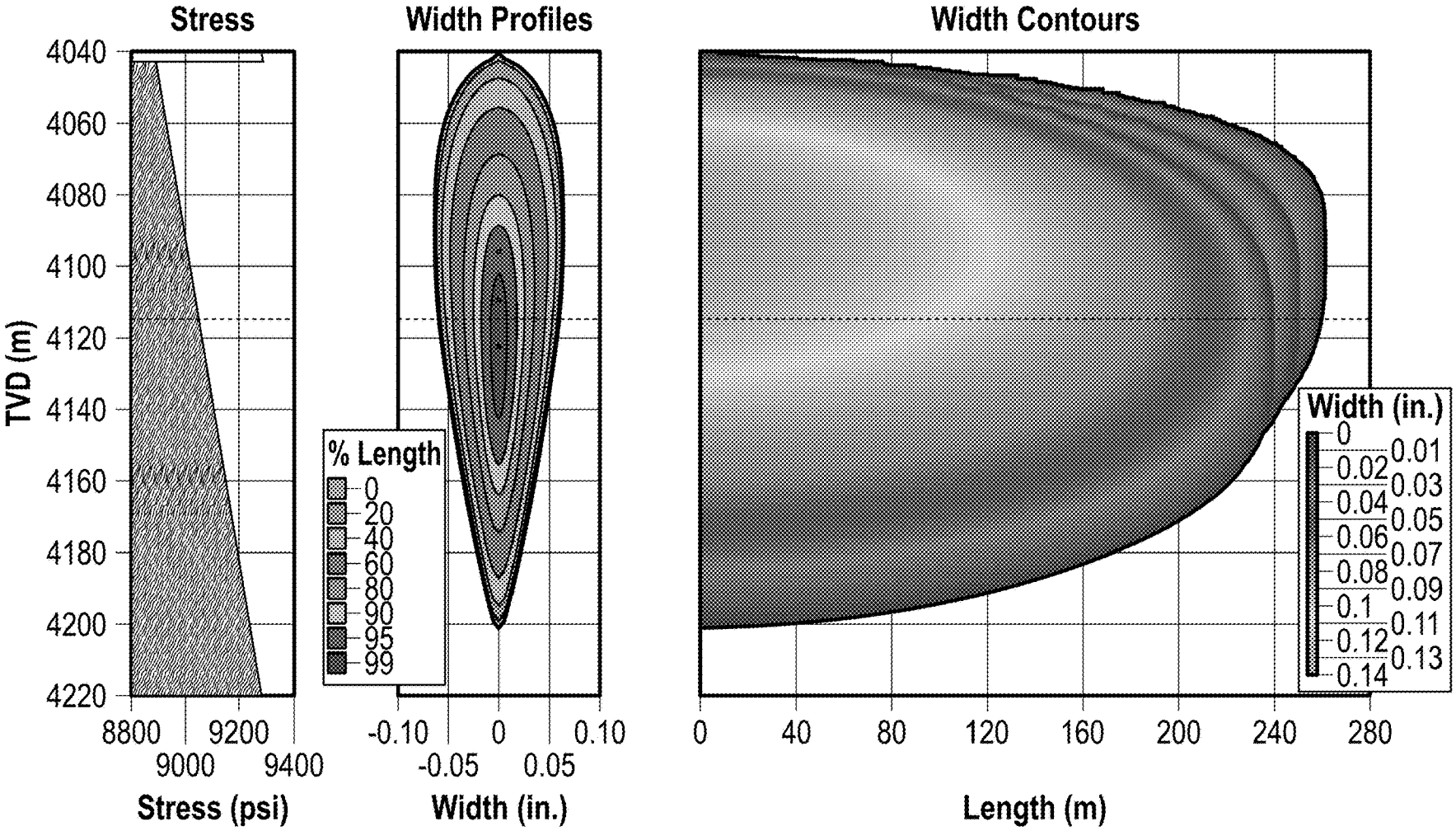
FIG. 7 is a graph schematically illustrating stress, width profile, and width contours produced by a simulated main stimulation treatment of the same subterranean geologic formation of FIG. 6 using a vertical injector well after the main stimulation and stimulation known under the trade designation StimBlock™.
Figure 8:
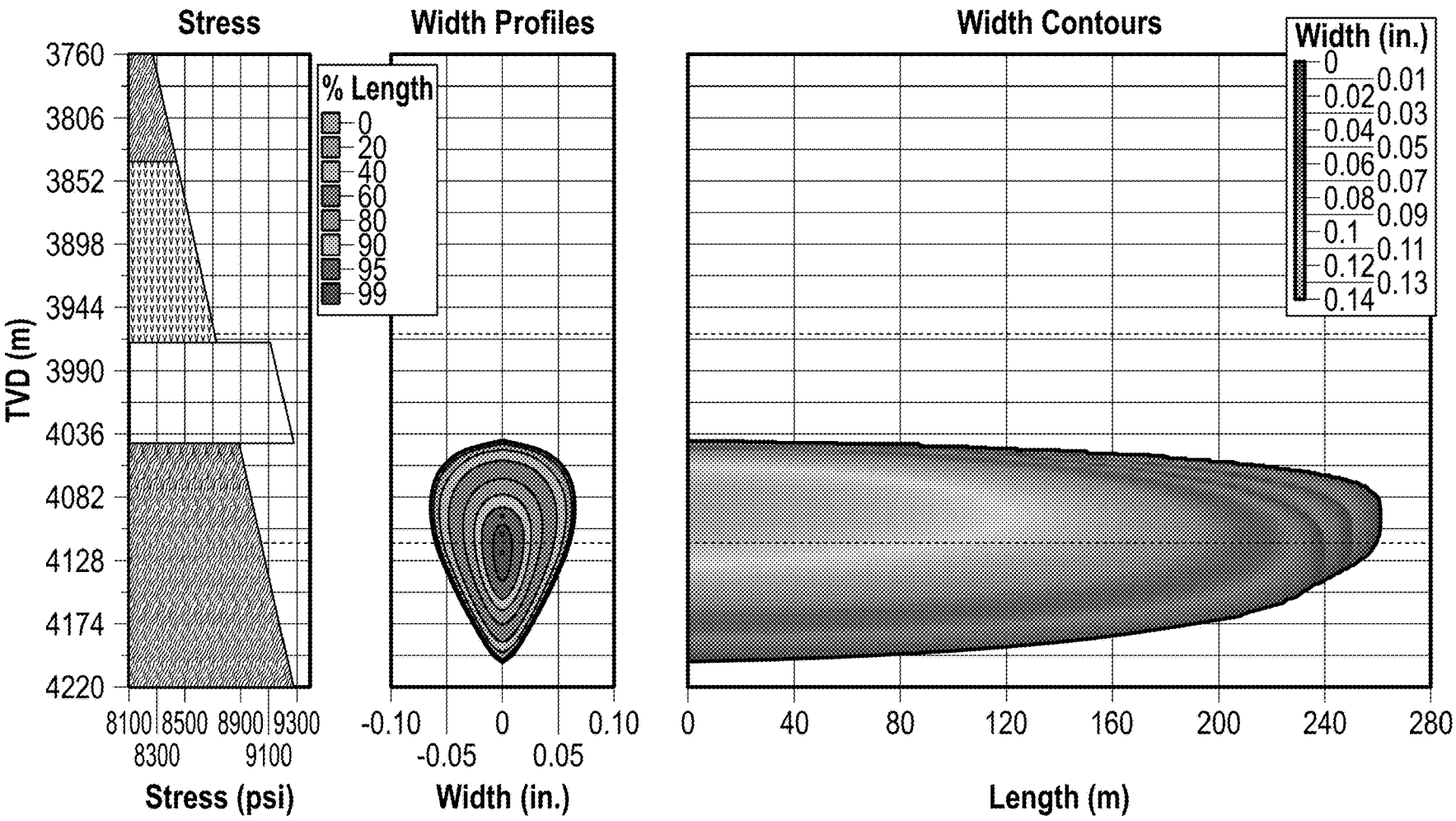
FIG. 8 presents the same data as FIG. 7 but with scales corrected.

FIG. 6 is a graph schematically illustrating stress, width profile, and width contours produced by a simulated treatment of the same subterranean geologic formation of FIG. 5 using a vertical injector well with stimulation known under the trade designation StimBlock™. The simulation employed 50,000 gallons of stimulation fluid flowing at 10 barrels per minute, at a location 200 feet above the main stimulation. FIG. 7 is a graph schematically illustrating stress, width profile, and width contours produced by a simulated main stimulation treatment of the same subterranean geologic formation of FIG. 6 using a vertical injector well after the main stimulation and stimulation known under the trade designation StimBlock™. Note that before use of stimulation known under the trade designation StimBlock™ (FIG. 5) that the main stimulation fluid reached a vertical depth of about 3800 m, and width of about 0.18 inch, whereas employing stimulation known under the trade designation StimBlock™ prior to the main stimulation, the main stimulation fluid reached a vertical depth of only about 4040 m, and a width of only about 0.07 inch. This may plainly be seen in FIG. 8.

Figure 9:
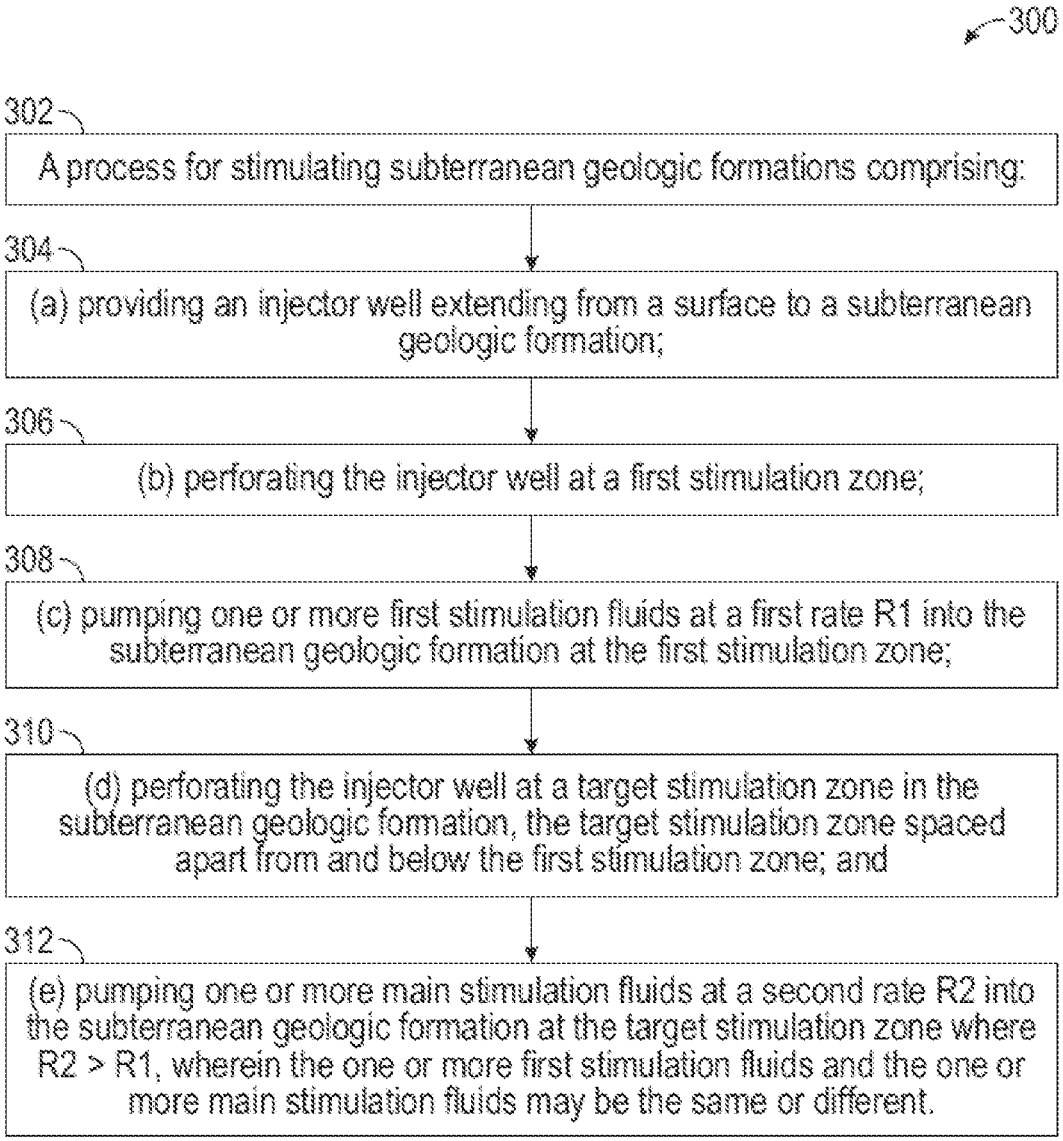
FIG. 9 is logic diagram illustrating one process in accordance with the present disclosure.

FIG. 9 is logic diagram illustrating one process embodiment 300 in accordance with the present disclosure. Embodiment 300 is a process for stimulating subterranean geologic formations to create an artificial stress barrier (box 302), comprising:

(a) providing an injector well extending from a surface to a subterranean geologic formation (box 304);

(b) perforating the injector well at a first position (box 306);

(c) pumping one or more first fluids at a first rate R1 into the subterranean geologic formation at the first position forming an artificial stress barrier at the first position to create a stimulation block at the first position (box 308);

(d) perforating the injector well at a second position in the subterranean geologic formation, the second position in the subterranean geologic formation spaced apart from and below the first position (box 310);

(e) pumping the one or more second fluids at a second rate R2 into the subterranean geologic formation at the second position, R2 being suitable for a normal stimulation of a fracture extending from the injector well to or near a producer well, where R2>R1, and wherein the one or more first and second fluids may be the same or different (box 312).

Figure 10:
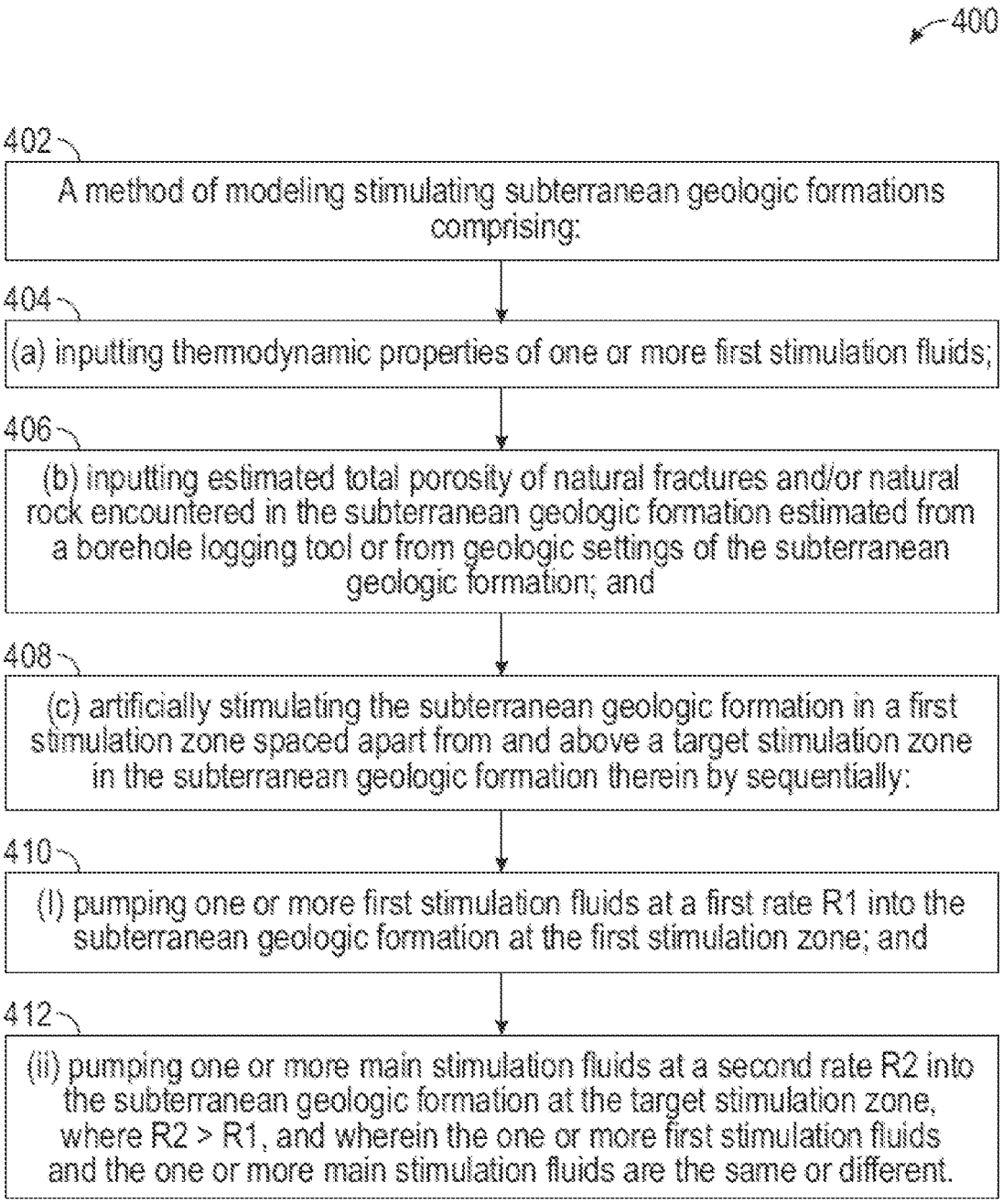
FIG. 10 is a logic diagram illustrating one modeling method in accordance with the present disclosure.

FIG. 10 is a logic diagram illustrating one modeling method embodiment 400 in accordance with the present disclosure. Embodiment 400 is a method of modeling stimulating subterranean geologic formations to create an artificial stress barrier (box 402), comprising:

(a) inputting thermodynamic properties of one or more first fluids (box 404);

(b) inputting estimated total porosity of natural fractures and/or natural rock encountered in the subterranean geologic formation estimated from a borehole logging tool or from geologic settings of the subterranean geologic formation (box 406); and (c) estimating artificial stress barrier effectiveness in the subterranean geologic formation after artificially stimulating the subterranean geologic formation to form an artificial stress barrier in a first position spaced apart from and above a second position in the formation therein by sequentially (box 408):

(i) pumping one or more first fluids at a first rate R1 into the subterranean geologic formation at the first position forming the artificial stress barrier at the first position (box 410); and (ii) pumping one or more second fluids at a second rate R2 into the subterranean geologic formation at the second position, R2 being suitable for a main stimulation of a fracture and/or natural non-fractured rock extending from the injector well to or near a producer well, where R2>R1, and wherein the one or more first and second fluids may be the same or different (box 412).

Tensile stimulation of host rock utilizing water, brine, energizing fluids or polymer-based fluids may be accomplished through dual injection paths between tubing and annulus depending on intensity and reservoir rock desired location. The tubing may be tubing in place, drill pipe, or coiled tubing. Jetting nozzles may be utilized for creating wellbore to rock fluid flow connections (connected paths). An angular abrasive material may be employed to achieve erosion and breakthrough the tubular materials separating jet nozzle tool and host rock. Dual injection in the tubing and annulus for generation of tensile fractures at desired depth may be accomplished using propping agents such as sand, bauxite and petroleum coke particles in sequences pertaining to a desired design.

Sub-tensile geometry pumping works through application of hydraulic energy utilizing water, brine, energizing fluid or polymer-based fluid to generate stress/pressure in the formation less than Shmin.

In certain embodiments, the modeling method outputs may include:

Temperature at stimulation fluid injection location (° C.);

Fluid Temperature at surface, at or near fluid injection position (° C.);

Pump/Standpipe Pressure (psi);

Fluid Pressure at surface, at or near fluid injection position (psi);

Annular Velocity of stimulation fluid (m/s); Density of stimulation fluid at surface, at injection point (kg/m$^3$);

Plus various graphical displays of pressure and temperature profiles, profiles of other properties (density, specific heat, and the like).

Operationally, the pump or pumps may operate at up to 20,000 psi pump pressure rating typical for land rigs. Certain embodiments may include specialized equipment, such as high pressure pumps, coiled tubing rigs, and combinations thereof. Standpipe pressure (SPP) above 15,000 psi is considered extreme. For this case study, we notionally target between 3,000 psi and 10,000 psi standpipe pressure.

Control devices may comprise a combination of: one or more pressure control devices, also referred to as chokes; one or more temperature control devices; one or more stimulation fluid pumping devices; one or more flow measurement devices (also referred to herein as mass flow meters or mass flow sensors); and in certain embodiments one or more accessory equipment such as one or more connectors, one or more isolation valves, one or more pressure relief devices, among others. The specific configuration of the well, drillstring, and fracturing sequences define the capabilities of each system and process embodiments. Redundancy of components may allow for extended service periods and mitigates risk of downtime due to component failure. An example would be a pressure control device (choke) plugging, or washout due to erosion. In this case, isolating the failed component and enabling another one allows for continued operations, and enables evaluation and/or modification of the operational parameters to minimize the risk of failure of the new component in use.

A dedicated contingency pressure control device may be used to quickly react to sudden increases in pressure, potentially due to one or more operational pressure control devices plugging with drilled cuttings, or other reasons. This contingency pressure control device may be controlled by an automated system to open and regulate a maximum pressure set point providing time to enable additional flow paths to bypass the blocked component, if available, or to stop operations to correct the deviation.

A mass flow meter may enable monitoring the stimulation fluid flow rates, and aid in comparison of fluid flow and density out of the producer well against fluid flow and density being pumped into the injector well.

During operation, one or all of T, P, mass flow rate, gas or vapor concentrations (or percentages of set point values) inside and/or outside the tubing and in the annulus may be displayed locally on Human Machine Interface (HMI), such as a laptop computer having display screen having a graphical user interface (GUI), or handheld device, or similar. In certain embodiments the HMI may record and/or transmit the data via wired or wireless communication to another HMI, such as a laptop, desktop, or hand-held computer or display. These communication links may be wired or wireless.

One or more control strategies may be employed. A pressure process control scheme may be employed, for example in conjunction with the pressure control devices and mass flow controllers. A master controller may be employed, but the disclosure is not so limited, as any combination of controllers could be used. Programmable logic controllers (PLCs) may be used.

Control strategies may be selected from proportional-integral (PI), proportional-integral-derivative (PID) (including any known or reasonably foreseeable variations of these), and may compute a residual equal to a difference between a measured value and a set point to produce an output to one or more control elements. The controller may compute the residual continuously or non-continuously. Other possible implementations of the disclosure are those wherein the controller comprises more specialized control strategies, such as strategies selected from feed forward, cascade control, internal feedback loops, model predictive control, neural networks, and Kalman filtering techniques.

Injector wells, producer wells, pumps, and other components described herein may be built to meet ISO standards, Det Norske Veritas (DNV) standards, American Bureau of Standards (ABS) standards, American Petroleum Institute (API) standards, and/or other standards.

In certain embodiments, internal algorithms in the logic device, such as a PLC, may calculate a rate of increase or decrease in pressure inside the tubing and/or annulus. This may then be displayed or audioed in a series of ways such as "percentage to shutdown" lights or sounds, and the like on one or more GUIs. In certain embodiments, an additional function within a HMI may be to audibly alarm when the calculated pressure rate of increase or decrease reaches a level set by the operator. In certain embodiments this alarm may be sounded at the well site, as well as remote from the well site, for example in a shipboard control room, or remote control room.

What has not been recognized or realized are systems and processes for controlling location of flow of stimulation fluids in subterranean geologic formations, in particular geothermal formations, that are robust and safe. What also has not been recognized or realized are methods of modeling control of location of flow of stimulation fluids in a subterranean geologic formation. Systems and processes to accomplish this without significant risk to workers is highly desirable.

Thus the systems, processes, and modeling methods described herein afford ways to perform controlling location of flow of stimulation fluids in a subterranean geologic formation efficiently, safely and economically, and with significantly reduced risk of injury and discomfort to site workers.

From the foregoing detailed description of specific embodiments, it should be apparent that patentable systems, processes, and modeling methods have been described. Although specific embodiments of the disclosure have been described herein in some detail, this has been done solely for the purposes of describing various features and aspects of the systems and processes, and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, some systems of this disclosure may be devoid of certain components and/or features: for example, systems devoid of cyclone separators, or devoid of filters; systems devoid of low-strength steels; systems devoid of threaded fittings; systems devoid of welded fittings; systems devoid of casing.

What is claimed is:

1. A system for stimulating subterranean geologic formations comprising:

(a) an injector well extending from a surface to a subterranean geologic formation and configured to be cemented and perforated;

(b) a pump configured to stimulate the subterranean geologic formation by:

(i) pumping through the injector well one or more first stimulation fluids at a first rate R1 into a first stimulation zone in the subterranean geologic formation, the first stimulation zone spaced apart from a target stimulation zone in the subterranean geologic formation;

(ii) pumping through the injector well one or more main stimulation treatment fluids at a second rate R2 at the target stimulation zone in the subterranean geologic formation, where R2>R1; and (c) a sub-system configured to measure blocking effect on the one or more main stimulation fluids in the target stimulation zone by the one or more first stimulation fluids in the first stimulation zone.

2. The system of claim 1 including one or more producer wells, wherein the subterranean geologic formation is a geothermal formation, and the injector well and the one or more producer wells is in dry hot rock (DHR).

3. The system of claim 2 wherein one or more of the producer wells is selected from an open hole, a well comprising a cemented liner, a well comprising an uncemented liner, and a well selectively segmented by embedded cylinder pipe and sliding sleeves or pre-perforated liner.

4. The system of claim 1 wherein the injector well is a vertical/deviated well and R1 is a rate and volume capable of tensile fracturing the subterranean geologic formation producing a stress/pressure in the subterranean geologic formation above minimum horizontal stress in the subterranean geologic formation and introducing a net pressure increase in the subterranean geologic formation.

5. The system of claim 1 wherein the injector well is a horizontal well at the target stimulation zone and the first stimulation zone is shallower than the target stimulation zone, and R1 is a rate and volume capable of limiting the effects of intersecting natural fractures creating complex fracture geometries selected from:

(i) a small tensile fracture producing a stress/pressure in the subterranean geologic formation above minimum horizontal stress in the subterranean geologic formation; and (ii) a hydroshearing fracture, the hydroshearing fracture producing a stress/pressure in the subterranean geologic formation below minimum horizontal stress in the subterranean geologic formation.

6. The system of claim 1 wherein the sub-system measures improvement in injectivity index (Q/DP).

7. The system of claim 1 wherein the sub-system measures pressure decline as compared by calculation of geothermal formation transmissivity (Kh/μ) improvement of existing natural fractures, where Kh is horizontal conductivity and μ is downhole fluid viscosity.

8. The system of claim 1 wherein the pump is one or more surface pumps.

9. The system of claim 1 wherein the one or more first stimulation fluids and the one or more main stimulation fluids are independently selected from water, brine, viscosified fluids, energizing fluids, and polymer based fluids.

10. The system of claim 1 wherein the injector well is configured to utilize single-path injection through either an inner conduit or through an annulus between the inner conduit and casing, wherein the inner conduit is selected from in place tubing, drill pipe, and coiled tubing.

11. The system of claim 1 wherein the injector well is configured to utilize dual injection paths comprising a first injection path through an inner conduit and a second injection path through an annulus between the inner conduit and casing, and wherein the pump comprises a first pump for the first injection path and a second pump for the second injection path.

12. The system of claim 11 wherein the first pump is configured to pump the one or more first stimulation fluids through the first injection path, and the second pump is configured to pump the one or more main stimulation fluids through the second injection path, wherein the one or more first stimulation fluids and the one or more main stimulation fluids are different in one or more physical and/or chemical properties.

13. The system of claim 1 wherein the one or more first stimulation fluids or the one or more main stimulation fluids are independently, or both the one or more fluids comprises a propping agent.

14. A process for stimulating subterranean geologic formations, comprising:

(a) providing an injector well extending from a surface to a subterranean geologic formation;

(b) perforating the injector well at a first stimulation zone;

(c) pumping one or more first stimulation fluids at a first rate R1 into the subterranean geologic formation at the first stimulation zone;

(d) perforating the injector well at a target stimulation zone in the subterranean geologic formation, the target stimulation zone spaced apart from and below the first stimulation zone; and (e) pumping one or more main stimulation fluids at a second rate R2 into the subterranean geologic formation at the target stimulation zone, where R2>R1, wherein the one or more first stimulation fluids and the one or more main stimulation fluids are the same or different, and measuring blocking effect on the one or more main stimulation fluids in the target stimulation zone by the one or more first stimulation fluids in the first stimulation zone.

15. The process of claim 14 including producing geothermal heat through one or more producer wells, wherein the subterranean geologic formation is a geothermal formation, and the injector well and the one or more producer wells is in dry hot rock (DHR).

16. The process of claim 15 wherein the one or more producer wells are selected from an open hole, a well comprising a cemented liner, a well comprising an uncemented liner, and a well selectively segmented by embedded cylinder pipe and sliding sleeves or pre-perforated liner.

17. The process of claim 14 wherein the measuring of blocking effect comprises measuring improvement in injectivity index (Q/DP), where Q is volume flow rate and DP is pressure drop.

18. The process of claim 14 wherein the measuring of blocking effect comprises measuring pressure decline as compared by calculation of geothermal formation transmissivity (Kh/μ) improvement of existing natural fractures, where Kh is horizontal conductivity and μ is downhole fluid viscosity.

19. The process of claim 14 wherein the pumping is provided by one or more surface pumps.

20. The process of claim 14 wherein the one or more first stimulation fluids and the one or more main stimulation fluids are independently selected from water, brine, viscosified fluids, energizing fluids, and polymer based fluids.

21. The process of claim 14 wherein the injector well is selected from vertical/deviated injector wells and horizontal injector wells.

22. The process of claim 14 wherein the pumping utilizes single-path injection through either an inner conduit or through an annulus between the inner conduit and casing of the injector well, wherein the inner conduit is selected from in place tubing, drill pipe, and coiled tubing.

23. The process of claim 14 wherein the pumping utilizes dual injection paths comprising first pumping the one or more first stimulation fluids in a first injection path through an inner conduit and second pumping the one or more main stimulation fluids in a second injection path through an annulus between the inner conduit and casing, and wherein the first pumping comprises use of a first pump for the first injection path and the second pumping comprises use of a second pump for the second injection path.

24. The process of claim 23 wherein the one or more first stimulation fluids and the one or more main stimulation fluids are different in one or more physical and/or chemical properties.

25. The process of claim 14 wherein the one or more first stimulation fluids or the one or more main stimulation fluids, or both comprises a propping agent.

26. A method of modeling stimulating subterranean geologic formations, comprising:

(a) inputting thermodynamic properties of one or more first stimulation fluids;

(b) inputting estimated total porosity of natural fractures and/or natural rock encountered in the subterranean geologic formation estimated from a borehole logging tool or from geologic settings of the subterranean geologic formation; and (c) artificially stimulating the subterranean geologic formation in a first stimulation zone spaced apart from and above a target stimulation zone in the subterranean geologic formation therein by sequentially:

(i) pumping one or more first stimulation fluids at a first rate R1 into the subterranean geologic formation at the first stimulation zone; and (ii) pumping one or more main stimulation fluids at a second rate R2 into the subterranean geologic formation at the target stimulation zone, where R2>R1, and wherein the one or more first stimulation fluids and the one or more main stimulation fluids are the same or different, and measuring blocking effect on the one or more main stimulation fluids in the target stimulation zone by the one or more first stimulation fluids in the first stimulation zone.

* * * * *